US005338581A

United States Patent [19]

Delot

[11] Patent Number: 5,338,581

[45] **Date of Patent: * Aug. 16, 1994**

[54] PROCESS AND APPARATUS FOR THE CONTINUOUS OR INTERMITTENT COATING OF OBJECTS IN A LIQUID MASS

[75] Inventor: Jose Delot, Sens, France

[73] Assignee: Delot Process, S.A., Trappes Cedex, France

[ * ] Notice: The portion of the term of this patent subsequent to Aug. 2, 2011 has been disclaimed.

[21] Appl. No.: 778,078

[22] PCT Filed: Jun. 8, 1990

[86] PCT No.: PCT/FR90/00405

§ 371 Date: Jan. 30, 1992

§ 102(e) Date: Jan. 30, 1992

[87] PCT Pub. No.: WO90/15166

PCT Pub. Date: Dec. 13, 1990

[30] Foreign Application Priority Data

Jun. 9, 1989 [FR] France ..... 89 07697
Aug. 29, 1989 [FR] France ..... 89 11344

[51] Int. Cl.[5] ..... B05D 1/00

[52] U.S. Cl. ..... 427/598; 118/639; 118/DIG. 11; 118/405

[58] Field of Search ..... 118/639, 234, DIG. 11, 118/405, 419; 427/434.6, 434.7, 433, 598, 432, 355, 367, 9; 137/827

[56] References Cited

U.S. PATENT DOCUMENTS

| | | | |
|---|---|---|---|
| 2,834,692 | 3/1955 | Tama . | |
| 3,626,964 | 12/1971 | Van Fossen . | |
| 3,701,357 | 10/1972 | Granstrom et al. . | |
| 3,939,799 | 2/1976 | Kanbara et al. . | |
| 3,970,112 | 7/1976 | Bernard . | |
| 4,082,207 | 4/1978 | Garnier | 137/827 |
| 4,169,426 | 10/1979 | Kornmann et al. . | |
| 4,171,707 | 10/1979 | Branover | 137/827 |
| 4,324,266 | 4/1982 | Garnier | 137/827 |
| 4,655,237 | 4/1987 | Gloor et al. . | |
| 4,904,497 | 2/1990 | Lewis | 427/598 |
| 4,947,895 | 8/1990 | Lillicrap | 137/827 |

FOREIGN PATENT DOCUMENTS

| | | | |
|---|---|---|---|
| 1225361 | 8/1978 | Canada | 427/558 |
| 859241 | 12/1952 | Fed. Rep. of Germany . | |
| 1037789 | 8/1958 | Fed. Rep. of Germany . | |
| 1157047 | 11/1963 | Fed. Rep. of Germany . | |
| 2239309 | 2/1974 | Fed. Rep. of Germany | 137/827 |
| 2733075 | 4/1978 | Fed. Rep. of Germany . | |
| 1457615 | 9/1966 | France . | |
| 2237975 | 2/1975 | France . | |
| 2318239 | 2/1977 | France . | |
| 2323772 | 4/1977 | France . | |
| 2647874 | 12/1990 | France . | |
| 1020334 | 6/1976 | Japan | 427/598 |
| 0716768 | 2/1980 | Japan | 427/598 |
| 61-235549 | 10/1986 | Japan . | |
| 1136954 | 5/1989 | Japan | 427/958 |
| 630617 | 10/1978 | U.S.S.R. | 137/82 |
| 777213 | 6/1957 | United Kingdom . | |
| 1299848 | 12/1972 | United Kingdom . | |
| 1308087 | 2/1973 | United Kingdom . | |

OTHER PUBLICATIONS

English Abstract of Japanese Application No. 61-235549.

*Primary Examiner*—Peter Chin
*Assistant Examiner*—Brenda Lamb
*Attorney, Agent, or Firm*—Sandler, Greenblum & Bernstein

[57] ABSTRACT

Method, housing and plant for the continuous/intermittent coating of objects by dipping the objects in a bath of liquid coating product contained in a housing provided with aligned inlet and outlet. The method permanently preserves the integrity of the liquid coating product, whether as a bath situated inside the housing or a liquid product circulating outside the housing. The housing includes a tubular body composed of material permeable to magnetic fields, and at least one electromagnetic valve positioned at each of the inlet and outlet ends of the housing. The electromagnetic valves are provided with multiphase field coils arranged around the tubular body to create a sliding magnetic field along the longitudinal axis of the tubular body, and elongated, magnetic cores fixedly positioned in the tubular body along a central, longitudinal axis of the tubular body.

20 Claims, 4 Drawing Sheets

PROCESS AND APPARATUS FOR THE CONTINUOUS OR INTERMITTENT COATING OF OBJECTS IN A LIQUID MASS

BACKGROUND OF THE INVENTION

1. Field of the Invention

The present invention relates to a method, housing and a plant for the continuous/intermittent coating of objects by the passage of the objects through a bath a liquid coating product. The present invention applies in particular to the specific case of the galvanizing of metal objects with metal base or metal alloy products, but also to plants allowing to apply a liquid coating product of any other kind, such as certain resins or paints on certain metallic or non metallic objects.

2. Discussion of Background Information

In the field of metallurgy, plants for the continuous hot galvanizing of metal objects with zinc, aluminium or their alloys, in particular, are well known. A continuous galvanizing method using aluminium is described for example in French Patent FR-1 457 615 filed in the name of "Colorado Fuel and Iron Corporation", while continuous galvanizing with zinc and its alloys is described in French Patent FR-2 323 772 filed, in the name of Delot. In these two documents, it is proposed to improve the quality of the zinc or aluminium base anti-corrosion coating carried out on an elongated metal object, such as a concrete wire, in observing a common elementary principle concerning the intermetallic layer which developes in contact with the object's surface and the coating product. This layer is necessarily thin so as to avoid the risk of reducing the resistance of the superficial protective coating, as it is well established that a thick intermetallic layer tends to crack and come apart from the surface of the object it is supposed to protect.

This obtaining 8 of a thin intermetallic layer requires a very short intimate contact between a metallic object, which should be perfectly pickled and cleared of all its oxides, and a galvanizing bath at a temperature close to or slightly higher than that of the object, the bath also being perfectly free from any contact with an oxidizing agent (atmospheric air, floating matte composing a germ of oxides).

To reach this result, the techniques proposed in the two above mentioned patents are identical in that all the operations necessary for continuous galvanizing, i.e., the pickling and the heating of the object to be heated, then the quick intimate contact between the object and the bath in the housing, and perhaps the immediate cooling of the covered object (to stop the thermal diffusion causing the intermetallic layer to grow)-takes place under the controlled atmosphere of a neutral or reducing gas, maintained under pressure and at a temperature at suitable values (usually, at atmospheric pressure and at a temperature close to that of the object and the bath of zinc or molten aluminium). Another fundamental point common to both techniques consists in that the inlet and outlet holes to the galvanizing housing are aligned for the passage of the object to be covered, which makes possible continuous galvanizing. This method is far more advantageous than the competing galvanizing methods called "immersion coating", often applied to sheet metal. In these "immersion coating" methods, it is necessary to carry out an intermediate fluxing between the pickling and galvanizing, with the aim of this fluxing operation being to momentarily protect the cleaned surface of the object to be coated when it is exposed to the air, before immersion in the galvanizing bath.

Apart from the points they have in common, both of the above mentioned continuous galvanizing methods differ in particular in the elements used for pickling the object to be coated and for its heating, and especially in the elements used to seal the inlet and outlet holes to the galvanizing housing in which the molten aluminium or zinc bath is found. In this respect, it should be noted that it is more beneficial to use the zingage method described in French Patent FR-2 323 772 for the following reasons:

the pickling of the metal object to be coated is carried out mechanically (cold shot blasting), not chemically (reduction by hydrogen at a high temperature), which spares the inherent mechanical properties of the object generally made of steel, and for which there is a maximum temperature above which a change in its crystal structure occurs requiring annealing after galvanizing.

the heating, preferably by high frequency induction, is quicker and more profitable considering the energy balance of the plant, its control also being more accurate than heating by Joule effect. Moreover, in the case of certain steels having lost some of their mechanical qualities (especially elongation) due to cold drawing prior to their anti-corrosion treatment (namely concrete wire), an extremely short heating time combined with a galvanizing time, also very short, not only enables the avoiding of a structural modification of these steels, but also procures a rapid immersion of them, which allows the recuperation of their original mechanical properties prior to drawing.

In none of the previous methods is the tightness of the inlet and outlet holes to the galvanizing housing satisfactory, which causes leaks of the molten coating product outside the housing. These structural or accidental leaks should be recycled either through overflow holes especially provided in the wall of the housing or through one of the inlet or outlet holes of the housing. In both circumstances, to ensure the circulation of molten product from the melting furnace to the galvanizing housing or during the recycling of the same product between the latter and the melting furnace, the plants known for the setting up of the previous methods require the use of at least one pump. The continuous circulation of molten product within the plant causes an agitation in the melting furnace that might carry dross towards the galvanizing housing likely to cause obstructions within the circulation pump or in the various passages or conduits inside which the molten product circulates. Moreover even if there is no obstruction, this dross, floating on the galvanizing bath, could oxidize it and consequently alter the quality of the coating formed on the objects to be coated, as it clearly results from the continuous galvanizing principles shown in the methods described in the two above-mentioned methods.

In addition, it is important to note that the volume of the bath of molten coating product is always very important; however, as steel objects pass through the bath it becomes saturated in iron and an iron-zinc alloy is formed which is deposited at the bottom of the galvanizing housing in the form of mattes which are detrimental to the purity of the bath and consequently to the quality of the coating.

In fields other than metallurgy, identical problems occur in relation to the tightness of housings containing a liquid product for the coating of metallic or non-metallic objects, tightness defects then requiring a permanent recycling of the structural or accidental leaks occuring during the treatment for example, in the case of certain resins or paints, the hot or cold coating techniques are similar to those developed for metallization by hot galvanizing. Here again, the integrity of the liquid coating product should be preserved in the same way as a molten metal or metal alloy should be preserved from oxidation, whether it be in the housing where it is to be found in bath form or in the conduits for the recycling of the leaks of molten metal or metal alloy outside the housing.

SUMMARY OF THE INVENTION

The object of this invention is to eliminate serious inconveniences connected with known structural or accidental leaks of plants by proposing a method for the continuous/intermittent coating of objects through passage of the objects in a bath of liquid coating product contained in a housing offering aligned inlet and outlet holes, such method being applied, for example, to the coating by continuous/intermittent galvanizing of metallic objects with a molten metal or metal alloy or again to methods allowing the hot or cold application of a liquid coating of a completely different kind, such as certain resins or certain paints, on metallic or non-metallic objects, the method being characterized in that the integrity of the liquid coating product is continuously preserved, whether it is the bath situated inside the housing or the liquid product circulating outside this same housing.

According to a first version of this invention, are compensated the structural and/or accidental leaks from the housing containing the liquid coating product the integrity of which is to be preserved by recycling these leaks under controlled atmosphere, i.e., concerning, for example, the continuous galvanizing under controlled atmosphere of a neutral and/or reducing gas, the same controlled atmosphere also preserving the integrity of the liquid product contained in the housing.

According to a second version of the invention, the structural leaks from the housing containing the liquid coating product are prevented and the accidental leaks of the product outside the housing are compensated by recycling these leaks under controlled atmosphere, e.g. under the controlled atmosphere of a neutral and/or reducing gas, the same atmosphere here again preserving the integrity of the liquid product contained in the housing.

Finally, according to a third particularly interesting version of the method in compliance with this invention, all the structural and/or accidental leaks of liquid coating product are prevented outside the housing, which is placed under controlled atmosphere, for example, under controlled atmosphere of a neutral and/or reducing gas, so as to preserve the integrity of the bath of liquid product contained in the housing.

In the first version, it is noted that the recycling of the leaks of liquid coating product cannot be avoided, which again requires the use of at least one pump. On the other hand, compared with the previous art described in the French patents FR-1 457 615 and FR-2 323 772, the main addition to the invention consists in a permanent control of the integrity of the liquid product, not only within the housing but also outside of it, the recycling of the leaks taking place under controlled atmosphere.

To eliminate the inconveniences connected with structural and/or accidental leaks from non-tight housings used in this first version it was suggested in the field of continuous galvanizing, and, in particular, in U.S. Pat. No. 2,834,692; in British Patent GB-777 213 and in the application for French Patent FR-2 647 814 in applicant's name, to completely seal the galvanizing housing by means of multiphase field coils surrounding the inlet and outlet of the housing to create a sliding magnetic field tending to force back the liquid coating product inside the housing, these two field coils maintaining a "bubble" between each other, or a mass of molten metal or metal alloy that the object to be coated can cross directly. In this way, and according to the second version of the method concerned in this invention, the structural leaks of the housing containing the liquid coating product are prevented; all that remains is to compensate the accidental leaks of the liquid product outside the housing by recycling these leaks, if any, under controlled atmosphere. If the object to be coated is metallic, steel, for example, then the presence of this magnetizable object close to the center of the housing greatly contributes to the efficiency of the tight field coils. To the contrary, in the case of full extraction of this object outside the tubular body forming the housing, the field coils placed at the outlet and inlet of the housing should be excited by currents of extremely high intensities leading to a consequent over-dimensioning of the coils. So as to save electric energy, it is thus preferable to take all the suitable, but complex, steps for at least a part of an object to be continuously present within the tubular body composing the housing.

That is why, according to the third version of this invention, a housing is proposed, suitable for coating with a liquid coating product, for example with a metal or metal alloy base, continuous or non-continuous objects travelling through it in a continuous or intermittent way, according to parallel passage axes offset in relation to the longitudinal axis of the housing, characterized in that it includes a tubular body of a matter permeable to magnetic fields, preferentially not wettable by the liquid product and at each end, at least one electromagnetic valve including:

at least one multiphase field coil arranged round the tubular body to create a sliding magnetic field along the longitudinal axis of this same tubular body and tending to push the coating product back into the housing.

A core being one with the tubular body and stretching according to its axis so as to form between it and the internal wall of the tubular body, a passage of appropriate shape for the passing of the objects crossing the housing lengthwise.

In this way, all the structural and/or accidental leaks can be prevented in the housing containing the liquid coating product, the integrity of which is also preserved, inside the housing, since it is placed under controlled atmosphere, e.g. under atmosphere controlled by a neutral and/or reducing gas, inasfar as continuous galvanizing is concerned.

In all these versions, it should be noted that the volume of the liquid or molten product contained in the housing may be very small, or at least significantly smaller than the volume of the bath generally used by conventional methods, especially for hot galvanizing. Consequently, the bath is renewed very often as the liquid or molten product is deposited on the objects passing through the housing, and this greatly contributes to the preservation of the bath's integrity by reducing the harmful consequences of the chemical reactions between the latter and the objects treated, e.g., the iron-zinc reactions peculiar to the hot galvanizing of steel objects (formation of mattes). As a result of this invention, the association of small volume housings and a method continuously preserving the integrity of the liquid or molten coating product, especially vis-a-vis oxidation, the product being in a more or less tight housing and/or circulating to be recycled, or simply to feed the housing from an appropriate tank, thus procures unexpected and considerable advantages as to the quality of the coatings obtained in comparison with previous methods. The renewal of the bath thus combines a group parameters it is very easy and beneficial to control through the method in compliance with this invention. This renewal depends on several factors at the same time:

the speed of the passage of the objects to be treated in the housing, the length of this housing and its volume, which determines the time of contact between these objects and the bath which, it was noted, should be extremely short in compliance with the general teachings of continuous galvanizing method, the volume of the bath diminishing as the protective coating is deposited on the objects.

the rate of recycling of the accidental and/or structural leaks, if necessary.

the rate of supply to the housing from a tank containing the liquid or molten coating product.

In all cases a small volume housing will be sufficient, with a first advantage concerning the integrity of the bath contained within the housing as a result of the elimination of the harmful consequences of the chemical reactions that might occur between the bath and the objects to be treated and with the second advantage of favoring the control of the contact time by means of a sufficiently short, or even adjustable housing length, authorizing at the same time a passage speed which, the slower it is, the easier it will be to maintain. It should be noted that even in the case of a non-tight housing, a small volume of the bath contained in the housing is not incompatible with a high rate of renewal. Indeed, whereas in the prior methods it was logical to provide a housing with rather a large volume offering the advantage of being less contaminated from the dross resulting from the oxidation of the liquid product circulating outside the housing to be recycled, this invention, which continuously preserves the integrity of the product following the placing under controlled atmosphere of all the plant elements, allows a high renewal rate of the galvanizing bath and unexpectedly contributes towards the prevention of the formation of mattes polluting the bath.

It therefore clearly results that this invention comes to a particularly clever compromise between all the essential parameters of the continuous/intermittent coating methods and in particular hot galvanizing.

BRIEF DESCRIPTION OF THE DRAWINGS

Other characteristics and advantages will be shown better in the description, hereinafter of a tight housing and several versions of plants including the housing given as non-limiting examples of this invention, in reference to the attached drawing in which.

DETAILED DESCRIPTION OF THE PREFERRED EMBODIMENTS

In the same way, prior to the description that is to follow, it should be noted that the characteristics of the plants to be described and concerning the means of adjusting the feed rate of the tight housing are directly applicable to plants incorporating a structurally or accidentally non-tight housing. These characteristics concern therefore, in compliance with this invention, all versions of the method for coating objects using a liquid product contained in the housing.

Figure 1:
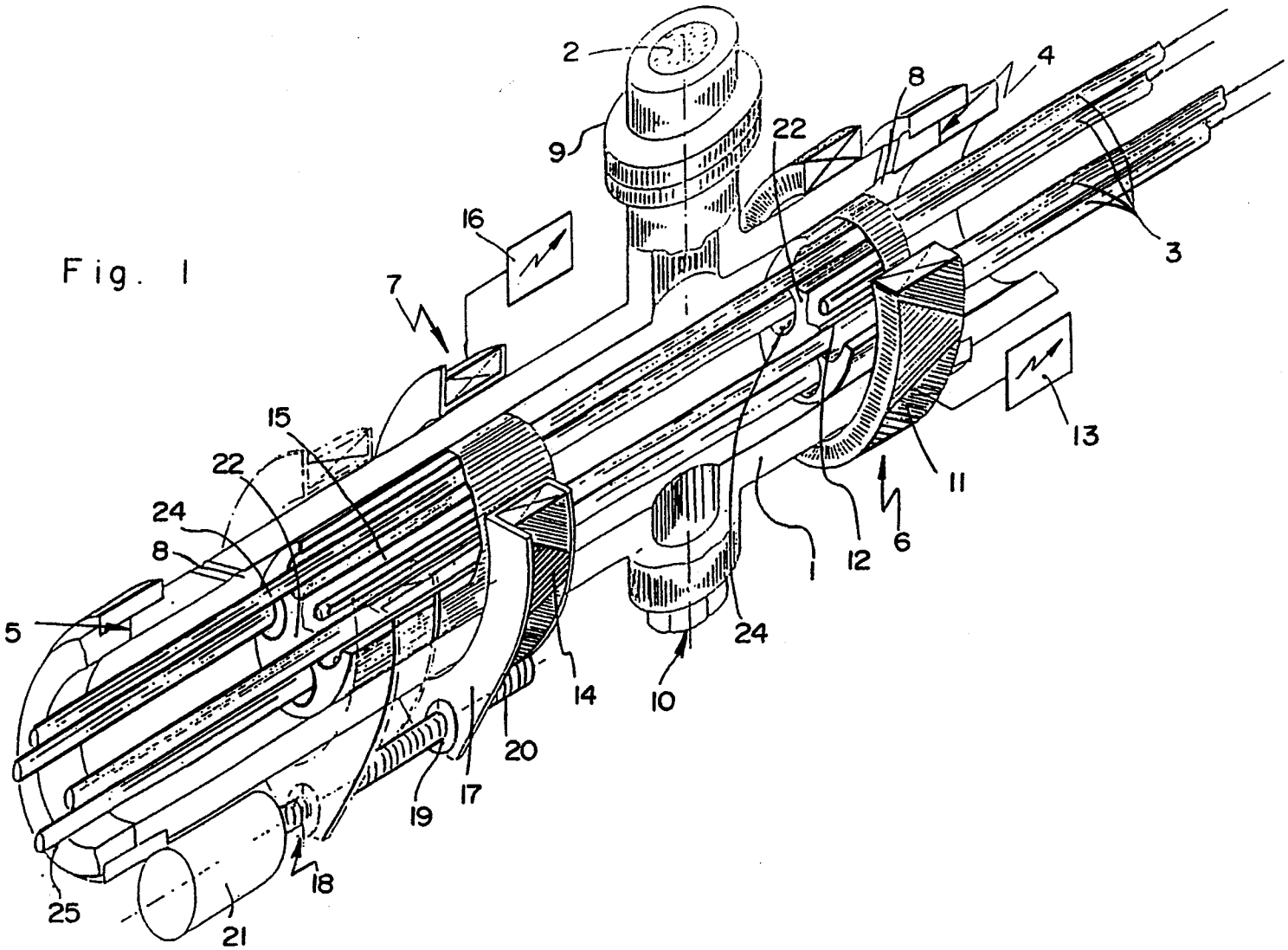
FIG. 1 is a partially exploded perspective view of the tight housing set up in the third version of the method in compliance with the invention, for the particular case of hot galvanizing, but without showing, for the clearness of the drawing, the complete galvanizing line.

The tight housing for hot galvanizing described in reference to FIG. 1, includes a tubular body 1 which is filled by appropriate means with a liquid product 2, such as molten zinc or an alloy of molten zinc, to coat objects 3, e.g., metallic, so as to protect them from corrosion. The tubular body 1 is open at both ends 4 and 5 to allow the passage of objects 3 to be coated. A first electromagnetic valve 6 placed at one of the ends 4 of the tubular body 1 allows the ceiling of the entry to the housing and a second electromagnetic valve 7 placed at the other end 5 of the tubular body 1 enables the outlet to be seated. In this way, a "bubble" of liquid product 2 is imprisoned between the two valves 6 and 7.

So as to avoid any oxidation of the objects 3, and of the liquid product 2, the housing is equipped with two injectors 8 allowing the control of the injection of a neutral or reducing gas into the tubular body 1.

The housing is supplied with liquid product 2 from a tank, not shown in FIG. 1, connected to the housing by a supply pipe 9. In addition, a drain hole 10, normally obturated, is provided on the housing and allows the emptying of the housing between two galvanizing programs so that the housing can be cleaned.

Moreover, the tubular body 1 and the supply conduit 9 includes, a heating device, not shown in FIG. 1. These devices, which can be composed of an inductive heater or classical heating electrical resistances, procure the heat necessary for maintaining in fusion the liquid product 2, such as molten zinc or a molten zinc alloy. It is obvious that these heating devices would be useless in a cold coating method.

In compliance with the invention, the electro-magnetic valves 6 and 7 should preferably be valves of the type described in the application for French Patent FR-2 647 874, filed on Jun. 2, 1989, by the same applicant.

The valve 6 placed at the entrance to the tubular body 1, thus includes a multiphase field coil 11 surrounding the tubular body 1 at its end 4 to create a sliding magnetic field along the longitudinal axis of the tubular body 1.

a magnetic core 12 within the tubular body 1 and extending along the longitudinal axis, of the housing, the lines of the magnetic field therefore closing up within the core 12.

It should be noted that the tubular body 1 is, of course, made of a material permeable to the magnetic field, i.e., a ceramic. This material is, in addition, non-wettable by the liquid product 2.

A setting device 13 of the multiphase current intensity derived from a power source, not shown in FIG. 1, is connected to the inductive coil 11 which it supplies so that the created magnetic field tends to push back the liquid product 2 towards the inside of the housing. Indeed, energized by a current of an appropriate intensity, the field coil 11 creates, particularly in its middle, magnetomotive forces (shown by arrows in FIG. 1) which act on the liquid product 2, preventing its discharge through the entry to the tubular body 1.

In the same way, the valve 7 placed at the outlet of the tubular body 1 includes:

a multiphase field coil 14 surrounding the tubular body 1 at its end 5 to create a sliding magnetic field along the longitudinal axis of the tubular body 1.

a magnetic core 15 within the tubular body 1 and extending along the longitudinal axis of the housing, the lines of the magnetic field therefore closing up within the core 15.

A device 16 for setting the current intensity derived from the multiphase power source is connected to the field coil 14, which it supplies so that the magnetic field created tends to push back the liquid product 2 inside the housing. The magnetomotive forces created by the field coil 14 act on the liquid product 2 in the opposite direction to the forces created by the field coil 11 of the valve 6 and prevent its discharge through the outlet of the tubular body 1.

This type of electromagnetic valve 6, 7 with a fixed central magnetic core 12, 15 is extremely useful in solving the problem of interruption in the passage of an object or objects 3 to be coated inside the housing. Indeed, beyond the presence or the absence of objects 3 to be coated in the middle of the field coils 11, 14, of the valves 6,7, ensuring the tightness of the housing, a fixed core 12, 15 stretches out longitudinally in the middle of these coils 11, 14 so that the intensity level of the multiphase current intensity to be supplied, to avoid any leakage of coating liquid 2 outside the housing, remains within an admissible limit.

The objects 3 to be coated can consequently be presented to the entry to the housing in a continuous form, which is conventional, or in a discontinuous form, i.e., divided into several smaller pieces. The intermittence in the passage of the objects 3 to be coated through the housing resulting from this last provision do not require any complex action and make particularly advantageous the use of the tight housing using the method in accordance with this invention.

The working of such a housing will now be described. The objects to be coated 3 within the housing are entered into the housing through its end 4. After the passage in the housing and the hot metallurgical reaction with the liquid product 2, these objects 3 come out through the end 5 of the housing where they are simultaneously "wiped" through the action of the field coil 14 of the electromagnetic valve 7. It is indeed possible to set the thickness deposited on the objects 3, and to "wipe" the objects, i.e., keep this thickness constant.

In this way, the "wiping" can be monitored by controlling the intensity of the current circulating in the field coil 14 using the setting device 16. In practice, the remarkable efficiency of this type of control was noted in regard to the obtaining of protective layers of constant thickness on surfaces offering a high degree of roughness. Thus the metallurgical deposit obtained on classical concrete wire is perfectly regular. In particular, a concrete wire has a series of notches and raised parts called respectively imprints and locks, part of the profile of which is almost perpendicular to the longitudinal direction of the wire. Thanks to the housing of the invention, concrete wire plated with a constant thickness of a zinc alloy metallurgic plating was obtained, even in its most abrupt parts.

Moreover, it is important to note that no particular precaution should be taken when the objects 3 to be coated arrive discontinuously. The intermittence in the passage of these objects 3 through the housing can indeed easily be controlled by adjusting the intensity of the currents circulating within the field coils 11 and 14. Even in this case, and in compliance with the method of the present invention, the liquid product 2 trapped within the housing cannot leak out of the housing either structurally or accidentally, so there is no leakage to recycle and the protective coating thus realized on the objects 3 is of a very high standard.

Besides this, the field coil can be mobile and move on a suitable support 17, which may, for example, include a means 18 of setting the position of the field coil 14 along the end 5 of the tubular body 1. This means 18 of setting can itself include a nut 19, connected to the support 17 and a classic worm screw 20 driven in rotation by a stepping motor 21. The volume of liquid product 2 trapped between the valves 6 and 7 therefore varies—in FIG. 1 the field coil 14 is shown in full lines near to its extreme position and in broken lines at a particular position along the end 5 of the tubular body 1. It can also be noted that the core 15 of the electromagnetic valve 7 is consequently longer than the core 12 of the electromagnetic valve 6 which is fixed. Moreover for an established position of the coil 14, only the part of the core 15 in the middle of the coil 14 is used.

This last arrangement allows the contact time between the objects 3 and the liquid product 2 to be controlled for a given passage speed of the object 3 within the housing. It should also be noted that this contact time is an essential factor in continuous the tight housing for setting up the method in invention provides an extra parameter which is very important for quality and thickness control of the liquid product 2 deposited on the objects 3. Moreover, the setting of the bath volume contained in the tight housing, obtained by this method, contributes towards maintaining the integrity of the liquid product 2 in relation to the chemical reactions, such as the zinc-iron reactions occuring in contact with the objects 3 and the liquid product 2.

In compliance with an extra characteristic of the tight housing according to the invention, the cores 12 and 15 of the electromagnetic valves 6 and 7 allowing the sealing of the housing are held longitudinally within the central area of the tubular body 1 by means of cross-pieces 22, the shape of which is adapted to the section of the tubular body 1 and to the profile of the cores 12 and 15 respectively. The cross-pieces 22 also have separating spaces 24 between the cores 12 and 15 and the internal surface of the tubular body 1.

The separating spaces 24 usefully form areas for the passage of the objects 3. The passage axes of these objects 3 through the housing are thus offset in relation to the longitudinal axis of the tubular body 1.

This unexpected effect gives the considerable, additional advantage of multiplying, for a given passage speed, the object 3 production capacity, covered with a coating 25 of liquid product 2 base, by a factor equal to the number of separating spaces 24 made in each of the valves 6 and 7. In addition, it is easy to imagine that the separating spaces 24 to be found on level with the electromagnetic valve 6 located at the entry to the housing are aligned longitudinally on the separating spaces 24 which match them at the electromagnetic valve 7 level situated at the outlet to the housing. It is obvious that the straight sections of the tubular body 1, of the cores 12 and 15 and of the separating spaces 24 are adapted to the section of the objects 3 to pass through the housing in which they are to be treated.

Moreover, the magnetizable volume which is situated in the middle of the field coils 11 and 14, amongst other parameters, defines the current intensities that should circulate within it to seal the housing:

It should be noted that in the known case where the object 3 to be coated acts as a core (as in the above mentioned French patent application FR-2 647 814), the magnetizable volume continuously varies with the section of this object 3 and its nature. An accurate and good quality monitoring of the current intensity is then necessary in order to be able to control the leaks of liquid product 2 and the thickness of the deposit of this liquid product 2 on the object 3 crossing the housing.

Figure 2:
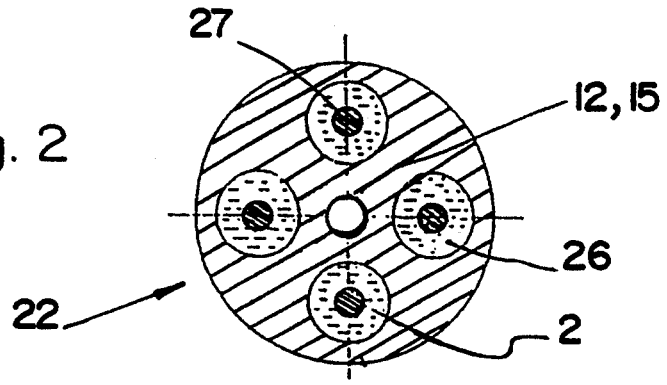
FIGS. 2 to 5 are successive examples of a cut away view of the housing shown in FIG. 1 at the level of the electromagnetic valves with which it is fitted, these views being limited to the cutting plane.

However, in the case of the tight housing described herein, which is equipped with a set of fixed magnetic cores 12, 15, the properties of these cores 12, 15, including their magnetic sensitivity and their section, for example, can be chosen so as to make the setting of the electromagnetic valves 6 and 7 very slightly sensitive vis a vis the passage of the objects 3 close to these cores 12, 15. Indeed, the magnetizable volume which determines the intensities of the multiphase currents to circulate in the field coils 11, 14 to seal the housing, can then be mainly composed of the volume of the fixed cores 12, 15. Several examples of tubular bodies 1 will now be described. In accordance with FIG. 2, which is a cross-section of the tubular body 1 at the level of one of cores 12 or 15, the tubular body 1 can be a circular cross-section the magnetic core 12 or 15 can be a plain cylindrical bar whose cross-section is a disk, and the cross-pieces 22 delimit the separating spaces 24, for example, of circular or oval section such as the separating spaces 26. A housing equipped with two valves 6 and 7 offering such a cross-section can be used namely for treating concrete wires 27 against corrosion. This particular case, given as an example, corresponds to the housing shown in FIG. 1.

Figure 3:
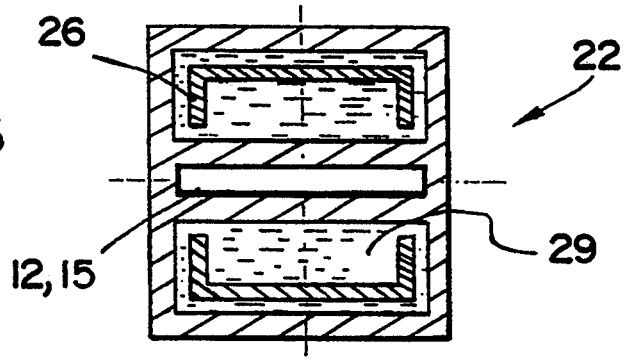
Figure 4:
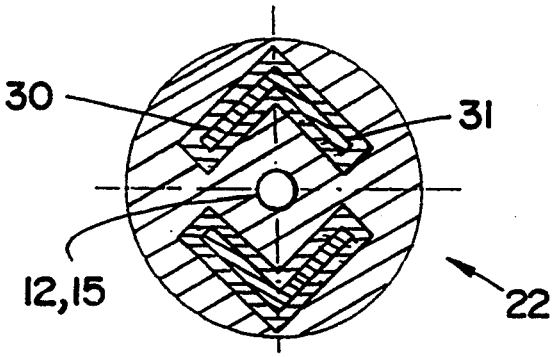

In the same way, in accordance with FIGS. 3 and 4, steel profiles for example, can be treated. In FIG. 3, is shown a group of two "U" angle brackets crossing the housing at the same level as the valves 6 and 7 through the provided passages, between highly simplified cross-pieces 22, by means of rectangular cross-section separating spaces 29. The magnetic cores 12 and 15 are then elongated sheets.

In FIG. 4, is shown a group of two profiles 30 crossing the housing at the level of the valves 6 and 7 through the provided passages, between cross-pieces 22 that largely fill the volume of the tubular body 1, by means of separating spaces 31 of a cross-section homothetic to the cross-section of a profile. The magnetic cores 12 and 15 are then plain cylindrical bars.

In a more general way, the cross-section of the interpolative spaces 24 is advantageously homothetic to the cross-section of the objects 3 to be treated.

Figure 5:
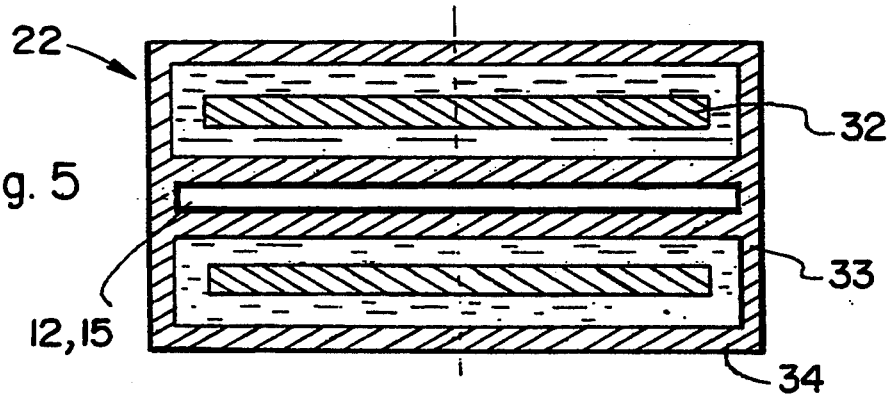

Finally, in accordance with FIG. 5, steel sheets 32, for example, can be treated. These sheets 32 cross the housing at the level of the valves 6 and 7 through the passages provided between very simplified cross-pieces 33, through separating spaces 34 with a rectangular cross-section. The cores 12 and 15 are then composed of elongated magnetic sheets.

The cores 12 and 15 of the valves 6 and 7, respectively can also appear in various shapes from rotational symmetrical to flat symmetrical or possibly asymmetrical (not illustrated). The choice of the cores 12 and 15 being moreover almost without effect on the working quality of the valves 6 and 7, it is easy for the specialist to adapt their form and the section of the separating spaces 24 to the type of object to be treated.

It is also possible to make the core of the valve removable so as to be able to use a specific tubular body 1 for each type of object 3 to be treated without having to replace the field coils 11 and 14 of the valves 6 and 7. It is indeed easy to make a multipurpose housing with a cross-section similar to an ellipse, for example, so as to simplify manufacture; the field coils 11 and 14, respectively present at the ends 4 and 5 of the tubular body 1 then being usable for a great many types of objects 3 to be coated, these objects 3 passing together and in parallel through the housing in a manner than can be continuous or intermittent.

Figure 6:
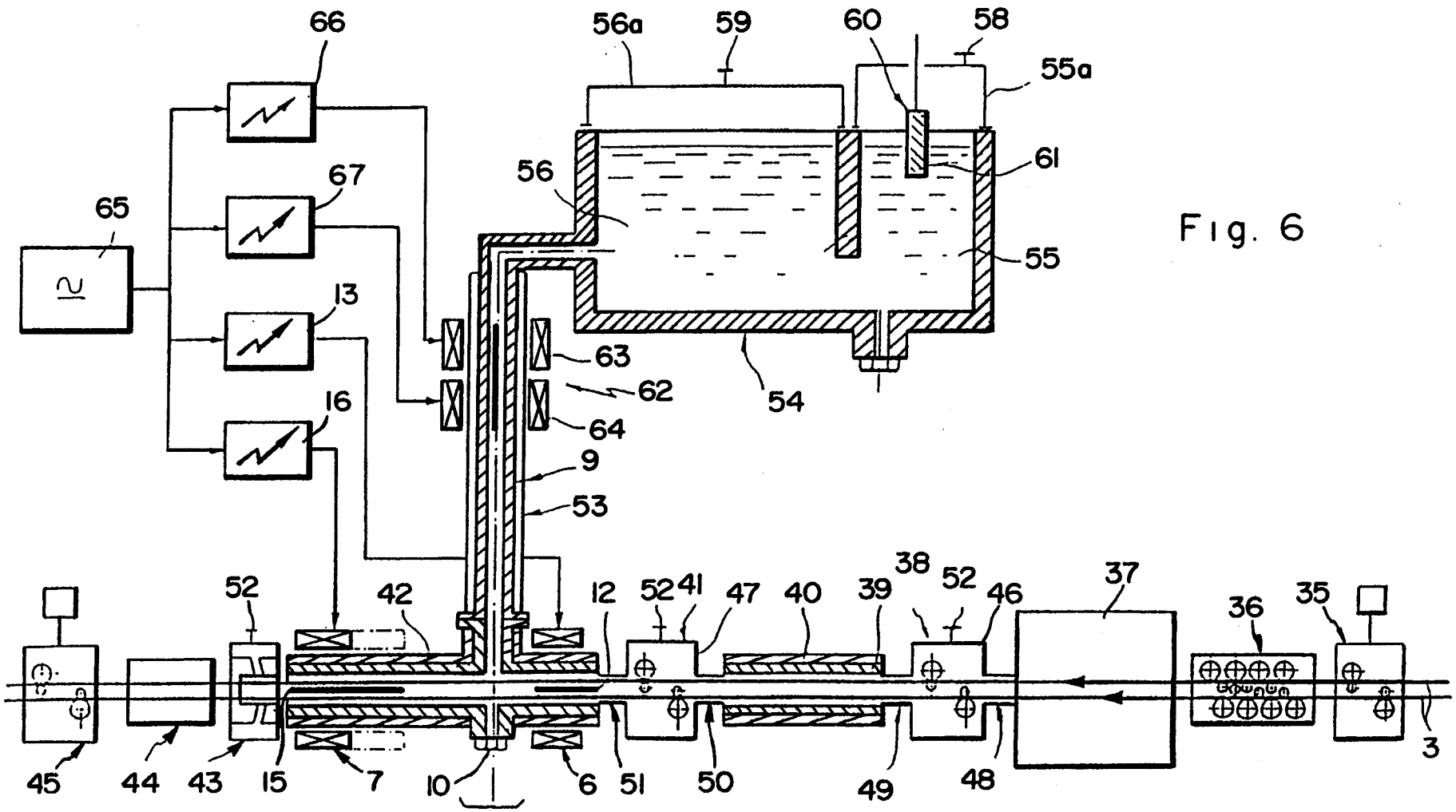
FIGS. 6 to 8 show in the form of a diagram, a hot galvanizing line incorporating the previous tight housing and successively three ways of adjusting the supply rate regulation of the housing. Tubular body will then be the name given to any body having the general shape of a cylinder, with a section of any profile, such as a circle, ellipse, parallelogram, for example, or any other more specific profile.
Figures 7, 8:
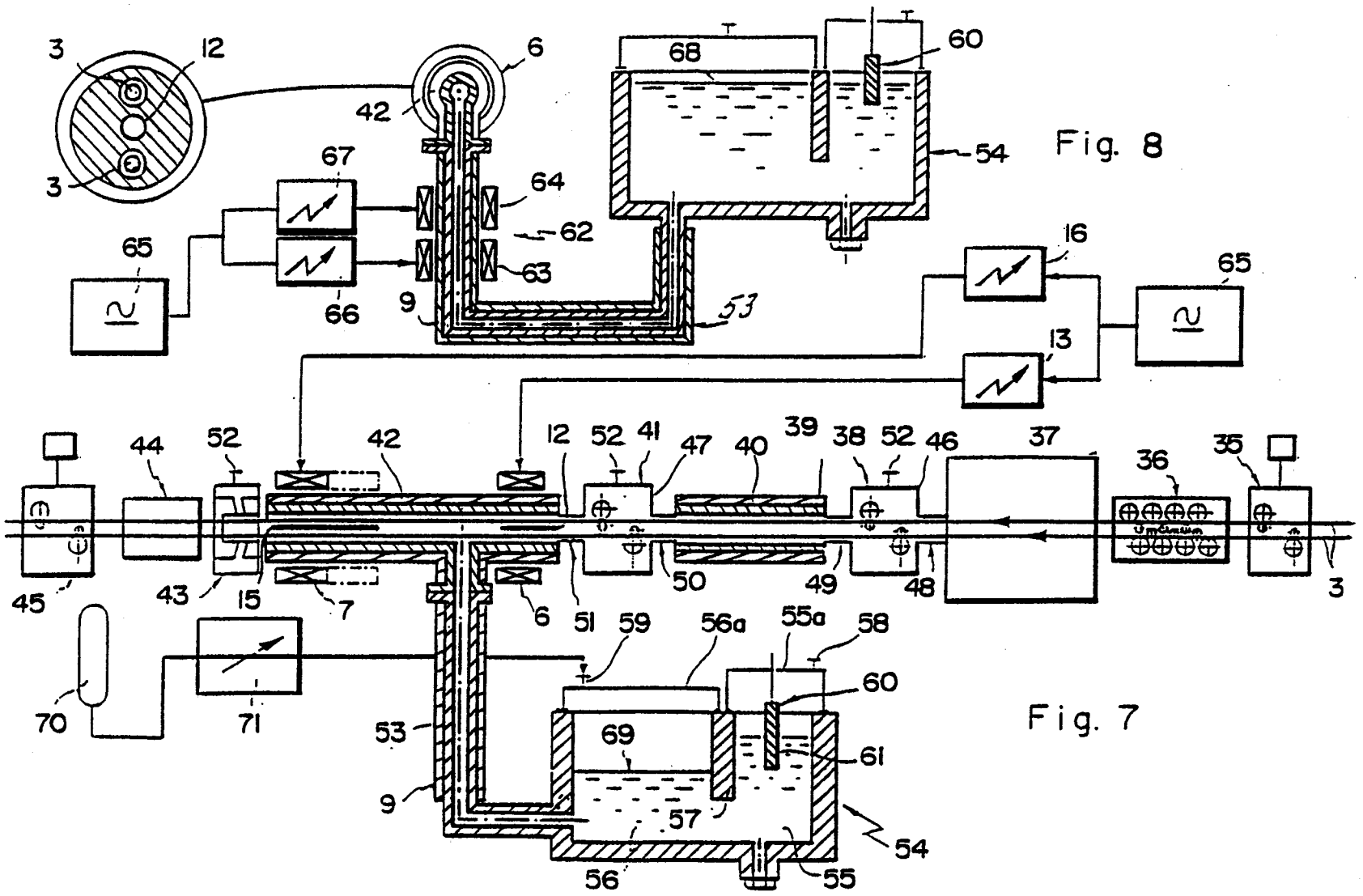

With reference to FIGS. 6 to 8, we shall now describe several plants for the setting up of the method in accordance with this invention and including, as a non-limiting example, a tight housing identical to the one that has just been described. In these figures, the main parts of the plant are shown as an axial section diagram and the housing can simultaneously treat two objects 3, such as concrete wire, passing in parallel, and which are placed for this purpose in a common vertical plane passing through the central cores 12, 15 of the valves 6 and 7.

In a way that is common to all the versions illustrated, the flow of liquid coating product 2 to the housing is regulated depending on the speed of the objects 3 to be coated in the housing and the required thickness of the coating 25, so that the quantity of liquid product 2 admitted into the housing compensates that which is absorbed by the formation of the coating 25 on the objects 3 coming out of the housing, with no significant reduction of the level of liquid product 2 within it, at the same time preserving the integrity of the liquid product 2. This setting of the feed rate to the housing is, let us repeat, essential for the preservation of the integrity of the bath contained in the housing vis-a-vis the chemical reactions occuring in contact with the objects 3 and the liquid product 2. This parameter partly controls the renewal rate of the bath in which is to be avoided in accordance with the teachings of the invention, the formation of precipitated solid residues in the form of zinc-iron salts, for example, in the case of hot galvanizing (mattes).

The setting up of continuous galvanizing shown in FIG. 6, usable for galvanizing objects 3 continuously or intermittently includes successively:

a) first device 35 for driving the objects 3 to be galvanized.

b) a rectifying device 36, for example, a roller or roller cage device adapted to the section of the objects 3.

c) a pickling assembly 37, including a shot-blasting unit, for example, to obtain an output of objects 3 offering a surface exempt from any impurity, and at the same time taking into account the speed, the section and the nature of these objects 3.

d) A first support device 38, with rollers to support the pickled, heated objects 3. The first support device 38 with rollers is intended to correct the deflection and vibration problems induced in the objects 3 by the whole pickling 37.

e) A heating tubular housing 39, made of a refractory material that supports a heating system 40, for example, with electromagnetic induction or with heating electric resistance, allowing to quickly heat the pickled objects 3 to an adjustable predetermined temperature suitable for the hot galvanization of these objects 3.

f) a second support device 41, with rollers, similar to the first support device 38, to support the pickled, heated objects 3.

g) a tight housing in compliance with that shown in FIG. 1. This housing is equipped with a heating device 42, for example, of the electromagnetic induction type. The tightness devices composed of the two electromagnetic valves 6 and 7 prevent any leak of molten metal out of the housing. Generally, these tightness devices can be of any known type and usually used in this kind of plant, with "structural" or "accidental" leaks of these devices being acceptable as long as these leaks are dealt with in compliance with the teachings of the object of this invention, i.e., in preserving outside of the housing the integrity of the liquid coating product 2.

h) an extra wiping device 43 set for sending in a known way a jet of neutral or reducing gas on the coating 25 just carried out on the objects 3. This device also realizes a first cooling of the objects 3 and avoids any corrosion of the molten metal contained in the housing in compliance with the teachings of this invention. It is possible not to have a wiping device 43, but even in this case it would be preferable to protect the objects 3 coming out of the housing still hot with an envelope of neutral or reducing gas avoiding any corrosion of these objects 3 and of the melted metal contained in the housing.

i) a controlled cooling device 44 to cool the product coming out from the wiping device 43 or from the galvanizing housing.

j) a second drive device 45 for the drive of the objects 3. Generally, it appears important to maintain the state of freshness of the products throughout their passage from the outlet to the pickling unit 4 to the extra wiping device 43.

For this purpose the two support devices 38 and 41 are at least respectively housed within the cases 46 and 47 connected by sections of conduits 48 and 49 to the pickling unit 37 and the heating housing 39 and by sections of conduits 50 and 51 to the heating housing 39 and to the galvanizing housing, respectively, and inside of which a protected atmosphere is created by the injection of a neutral or reducing gas so as to make impossible the corrosion of the products during the various phases of the treatment. For this purpose, injectors 52 are, for example, provided for the gas in the cases 46 and 47 and in the wiping device 43.

The inlet conduit 9 of the housing is connected to a furnace or tank 54 and is equipped with a heating device 53 similar to the heating devices 40 and 42. In the execution form of FIG. 6, the furnace or tank 54 include two compartments, i.e., a fusion compartment 55 and a draw-off compartment 56 separated from the fusion compartment 55 by means of a partition 57 providing a passage between its lower part and the bottom of the tank 54 to allow the melted metal to pass from compartment 55 to compartment 56. The top of the baths of melted metal contained in each of the two compartments 55 and 56 is under controlled atmosphere. For this purpose, each of the two compartments 55, 56 is protected by a lid **55*a*, 56*a* equipped with an injector 58, 59 by means of which a neutral or reducing gas can be introduced above the baths of melted metal to avoid their oxidation. The heating system of the tank 54 is normally quite classical. The melting compartment 55 is equipped with a system 60 that allows the introduction of metal ingots 61 through a tight lock, this introduction system 60 being set depending on the level of the bath in the draw-off compartment 56. In the plant in FIG. 6, the means of setting the feed rate to the housing are composed of a control valve 62, which is inserted into the inlet conduit 9 between the tank 54 and the housing. The valve 62 can be of any kind used to set the rate of a flow of molten metal. Preferably, this valve 62 is composed of an electromagnetic valve of a type that is in compliance with the application for FR-2 647 874 mentioned above. The two coils 63 and 64 of this valve 62 are supplied with current from the power source 65 via the respective devices for setting the current 66 and 67. Each of the two coils 63 and 64 is positioned and connected electrically so that, when it is fed with current, it produces an electromagnetic current sliding in the opposite direction to that of the flow of molten metal towards the housing, thus creating a magnetomotive force which is in opposition with the flow of molten metal. As the level of molten metal is in the tank 54 is maintained almost constant, the supply pressure of the molten metal is itself kept almost constant and the flow of molten metal towards the housing can be adjusted by setting the intensity of the energizing currents of the coils 63 and 64. The adjustment of the valve 62 can be carried out manually or, in a more elaborate plant, it is also possible to control the valve 62 according to one or several parameters of the working of the plants, for example, according to the speed of the passage of the objects 3** through the housing.

In the continuous galvanizing plant shown in FIG. 6, the tank 54 is situated at a certain distance above the galvanizing housing. However, as it is shown in FIG. 7, the tank 54 can be placed at approximately the same level as the housing, the level 68 of the molten metal in the tank 54 being however slightly higher than the highest level that the molten metal can reach inside the housing. In this case, the hydrostatic pressure of the molten metal admitted into the housing being lower than in the case of FIG. 6, the electrical power necessary for setting the supply flow of the molten metal to the housing is lower.

In the continuous galvanizing plant shown in FIG. 8, the level 69 of the molten metal in the draw-off compartment 56 of the tank 54 is lower than the level of the housing. The molten metal is pushed back towards the housing through the inlet conduit 9 by injecting into the tank 54, through the injector 59, an inert gas compressed to a sufficient pressure to raise the level of the molten metal in the inlet conduit 9 up into the housing. The compressed inert gas comes from a compressed inert gas source 70 via a pressure adjustment device 71. Furthermore, at least part of the inlet conduit 9 offers a section of calibrated passage. This can be obtained, for example, by placing a calibrated nozzle inside the conduit 9. Under these conditions the regulation of the housing's supply rate is operated by means of the pressure adjustment device 71.

Although the invention described is more especially related to a continuous galvanizing plant, it also concerns plants allowing the hot or cold, continuous or intermittent, application of a liquid coating product of an other kind such as, for example, paint or resin, on metallic or non metallic objects.

I claim:

1. Apparatus for continuously or intermittently coating continuous or non-continuous objects with a liquid coating product, said apparatus comprising:

a housing comprising a tubular body composed of material permeable to magnetic fields and adapted to contain a liquid coating product, said housing having a longitudinal axis, an inlet end and an outlet end; and at least one electromagnetic valve at each of said inlet end and said outlet end, comprising:

at least one multiphase field coil arranged around said tubular body to create a sliding magnetic field along the longitudinal axis of said tubular body, the sliding magnetic field capable of pushing back the liquid coating product within said tubular body; and an elongated, magnetic core fixedly positioned in said tubular body along a central, longitudinal axis of said tubular body.

2. The apparatus according to claim 1, comprising means for monitoring and controlling intensity of current circulating in a multiphase field coil at said outlet end to control thickness of the coating on the objects.

3. The apparatus according to claim 1, comprising at least two cross-pieces positioned within said tubular body, maintaining said magnetic core fixed in position along the central, longitudinal axis, and said at least two cross-pieces comprising separating spaces positioned between said magnetic core and an internal surface of said tubular body.

4. The apparatus according to claim 3, wherein said separating spaces comprise a cross-section which is homothetic to objects to be covered with the liquid coating product.

5. The apparatus according to claim 3, wherein said tubular body and said magnetic core have cross-sections, and said cross-pieces comprise a shape that is adapted to the cross-sections of said tubular body and the magnetic core.

6. The apparatus according to claim 5, wherein said separating spaces comprise a cross-section which is homothetic to objects to be covered with the liquid coating product.

7. The apparatus according to claim 1, wherein said tubular body comprises a removable tubular body which is replaceable without replacing said at least one multiphase field coil, whereby a specific tubular body can be used for different objects to be coated.

8. The apparatus according to claim 2, wherein said tubular body comprises a removable tubular body which is replaceable without replacing said at least one multiphase field coil, whereby a specific tubular body can be used for different objects to be coated.

9. The apparatus according to claim 4, wherein said tubular body comprises a removable tubular body which is replaceable without replacing said at least one multiphase field coil, whereby a specific tubular body can be used for different objects to be coated.

10. The apparatus according to claim 1, wherein one of said at least one electromagnetic valve at each of said inlet end and said outlet end is associated with a mobile support, said mobile support being movable with relation to one of said inlet end and said outlet end, so that a varying volume of liquid coating product can be trapped between an electromagnetic valve at the inlet end and an electromagnetic valve at the outlet end.

11. The apparatus according to claim 2, wherein one of said at least one electromagnetic valve at each of said inlet end and said outlet end is associated with a mobile support, said mobile support being movable with relation to one of said inlet end and said outlet end, so that a varying volume of liquid coating product can be trapped between an electromagnetic valve at the inlet end and an electromagnetic valve at the outlet end.

12. The apparatus according to claim 4, wherein one of said at least one electromagnetic valve at each of said inlet end and said outlet end is associated with a mobile support, said mobile support being movable with relation to one of said inlet end and said outlet end, so that a varying volume of liquid coating product can be trapped between an electromagnetic valve at the inlet end and an electromagnetic valve at the outlet end.

13. The apparatus according to claim 7, wherein one of said at least one electromagnetic valve at each of said inlet end and said outlet end is associated with a mobile support, said mobile support being movable with relation to one of said inlet end and said outlet end, so that a varying volume of liquid coating product can be trapped between an electromagnetic valve at the inlet end and an electromagnetic valve at the outlet end.

14. The apparatus according to claim 10, wherein said tubular body is composed of a material which is non-wettable by a liquid coating product.

15. The apparatus according to claim 14, wherein said material which is non-wettable by a liquid coating product comprises a ceramic material.

16. The apparatus according to claim 1, further comprising:

a constant level tank for containing the liquid coating product, said tank being positioned to be capable of containing a level of liquid coating product which is higher than an inlet opening in said inlet end of said tubular body and an outlet opening in said outlet end of said tubular body;

a supply conduit connecting said tank to said tubular body for supplying said tubular body with the liquid coating product; and an adjustment valve associated with said supply conduit, said adjustment valve being positioned between said tank and said tubular body.

17. The apparatus according to claim 1, further comprising:

a closed tank for containing a liquid coating product, said tank being positioned to be capable of containing a level of the liquid coating product which is lower than a level of liquid coating product in said tubular body;

a supply conduit connecting said tank to said tubular body for supplying said tubular body with liquid coating product;

a calibrated passage section associated with said supply conduit; and a regulating device to regulate pressure of a neutral gas above the level of liquid coating product in said tank.

18. A process for continuously or intermittently coating continuous or non-continuous objects with a liquid coating product, said process comprising:

passing at least one of continuous and non-continuous objects through a housing comprising a tubular body composed of material permeable to magnetic fields and containing a liquid coating product, the housing having a longitudinal axis, an inlet end and an outlet end; and at least one electromagnetic valve at each of the inlet end and the outlet end, comprising:

at least one multiphase field coil arranged around the tubular body to create a sliding magnetic field along the longitudinal axis of the tubular body, the sliding magnetic field tending to push back the liquid coating product within the tubular body; and an elongated, magnetic core fixedly positioned in the tubular body along a central, longitudinal axis of the tubular body.

19. The process according to claim 18, wherein the passing of objects through a housing comprises continually passing objects through the housing.

20. The process according to claim 18, comprising monitoring and controlling intensity of current circulating in a multiphase field coil at the outlet end to control thickness of the coating on the objects.

* * * * *

UNITED STATES PATENT AND TRADEMARK OFFICE

CERTIFICATE OF CORRECTION

PATENT NO. : 5,338,581
DATED : August 16, 1994
INVENTOR(S) : J. DELOT

It is certified that error appears in the above-indentified patent and that said Letters Patent is hereby corrected as shown below:

Column 1, line 10, change "a" to ---of---.

Column 1, line 38, change "obtaining 8" to ---obtaining---.

Column 3, line 4, change "treatment for" to ---treatment. For---.

Column 5, line 14, change "group parameters" to ---group of parameters---.

Column 6, line 5, change "these" to ---these successive---.

Column 8, line 49, change "continuous the" to ---continuous galvanizing. This particularity of the---.

Column 8, line 64, change "section of" to ---section profile of---.

Signed and Sealed this

Fourth Day of April, 1995

Bruce Lehman

*Attest:*

BRUCE LEHMAN

*Attesting Officer*

*Commissioner of Patents and Trademarks*